United States Patent [19]

Currie

[11] 4,182,047

[45] Jan. 8, 1980

[54] IRRADIATION UNIT

[76] Inventor: Kenneth F. Currie, 4/60 Sutherland Rd., Armadale, Victoria, Australia

[21] Appl. No.: 862,916

[22] Filed: Dec. 21, 1977

[30] Foreign Application Priority Data

Dec. 23, 1976 [AU] Australia ..... 8601/76

[51] Int. Cl.[2] ..... F26B 3/34; B01K 5/00

[52] U.S. Cl. ..... 34/1; 250/498

[58] Field of Search ..... 34/1, 4; 250/498; 219/343, 348, 354

[56] References Cited

U.S. PATENT DOCUMENTS

| | | | |
|---|---|---|---|
| 3,826,014 | 7/1974 | Helding | 34/1 |
| 3,894,343 | 7/1975 | Pray et al. | 34/1 |
| 4,005,135 | 1/1977 | Helding | 34/1 |
| 4,015,340 | 4/1977 | Treleven | 34/1 |

*Primary Examiner*—John J. Camby

*Attorney, Agent, or Firm*—Fleit & Jacobson

[57] ABSTRACT

An irradiation unit, especially adapted to use as a printer's ink drier, having means for mounting an elongate irradiator in an enclosure. In one embodiment, the irradiator is arranged for pivotal movement to and from a work position within the enclosure by being supported in one or more sleeve bearings. In another embodiment, provision is made for a ventilation hood to guide cooling air flow predominantly across and/or about the end contacts for the irradiator tube and the ends of the tube.

14 Claims, 5 Drawing Figures

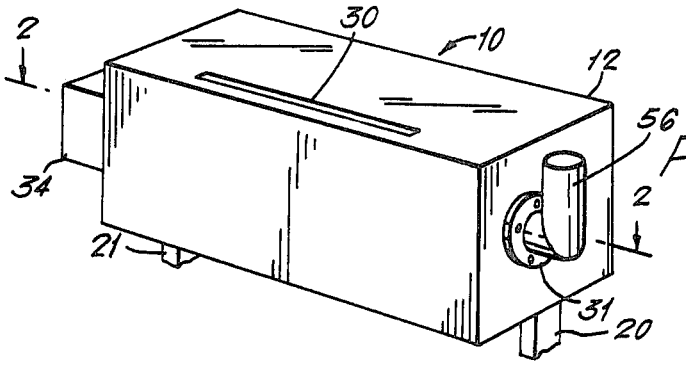
FIG. 1.
FIG. 4.
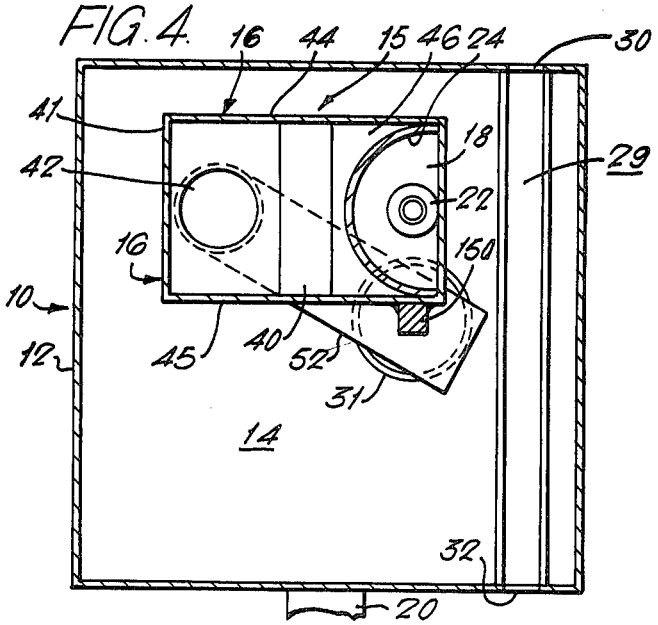
FIG. 5.
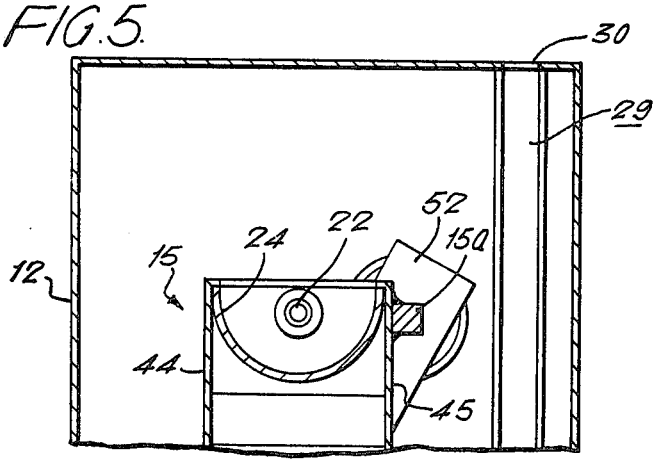

IRRADIATION UNIT

This invention relates to irradiation units of the kind having an elongate irradiator mounted in an enclosure and operable to emit electromagnetic radiation. The invention is particularly though by no means exclusively applicable to those units used in the drying of printing ink on a web of paper passed closely adjacent the irradiator. Irradiation units structured for this purpose are hereinafter referred to as ink driers.

Conventional ink driers include a housing defining an enclosure in which is mounted an elongate ultraviolet irradiator comprising a gas discharge tube backed along the length of one side by a reflector, typically parabolic in cross-section. Radiation is thereby concentrated to the other side of the tube at which an inked web of paper may be positioned by passing it through narrow slots in the drier housing. There are two important requirements for the proper operation of conventional ink driers of this type. These are the necessity to cool the irradiator and the need to prevent spontaneous ignition of the paper web through excessively prolonged exposure to the high temperature ultraviolet radiation. To date, the cooling requirement has been met by force ventilating one end of the tube, while ignition of the web during, for example, threading or non-movement of the web or the like, has been prevented by simply turning the tube off, which necessarily incurs much lost time during de-energization and restarting of the tube, or by employing a shutter arrangement while reducing the tube to half-power. Shutters have been the source of undesirable noise and vibration.

It is an objection of this invention to provide an improved irradiation unit in which the aforementioned problems are at least in part alleviated.

There is provided, in accordance with one aspect of the invention, an irradiation unit comprising an outer housing defining an enclosure; means for mounting an elongate irradiator, operable to emit electromagnetic radiation, for pivotal movement within the enclosure, which means includes one or more bearing sleeves received in an aperture or apertures in the housing; and means to permit ventilation of the irradiator to the exterior of the housing.

By employing a simple sleeved bearing, preferably a Teflon sleeve (Teflon a Registered Trade Mark), it is found that there are not the difficulties experienced in the high temperature environment with bearings such as roller and needle bearings. Preferably, the irradiator includes a tube operable to emit said electromagnetic radiation and the irradiator is pivotable about an axis parallel to the tube.

The hood may be pivotable with the irradiator within the enclosure, in which case the outlet port for the hood may communicate with the exterior of the housing by way of a duct passing through the or one of said bearing means within the sleeve of that bearing. A section fan may then be provided to draw air through this duct.

In a second aspect of the invention, an irradiation unit is provided comprising an outer housing defining an enclosure; spaced end contacts for retaining a gas discharge tube within said enclosure, a hood disposed to substantially close off one side of the tube; and an air outlet for the hood, wherein the interior of the hood is arranged such that in use the bulk of induced air flow through its outlet port has passed across and/or about the said end contacts and the ends of the tube.

Advantageously, the hood and irradiator or tube are arranged to be mounted in the enclosure so as to be jointly pivotable as an assembly between a condition in which the tube is operably exposed to a work space within the enclosure and a condition in which it is not so exposed. The work space may be a part of said enclosure disposed inwardly of an elongate slot through which inked paper may be passed for drying of the ink by the irradiator. Preferably, the unit includes drive means to perform said rotation of the hood and irradiator assembly.

The invention will now be described in greater detail by way of example with reference to the accompanying drawings, in which:

FIG. 1 is a front view of an irradiation unit designed as an ink drier constructed in accordance with the invention;

Figure 2:
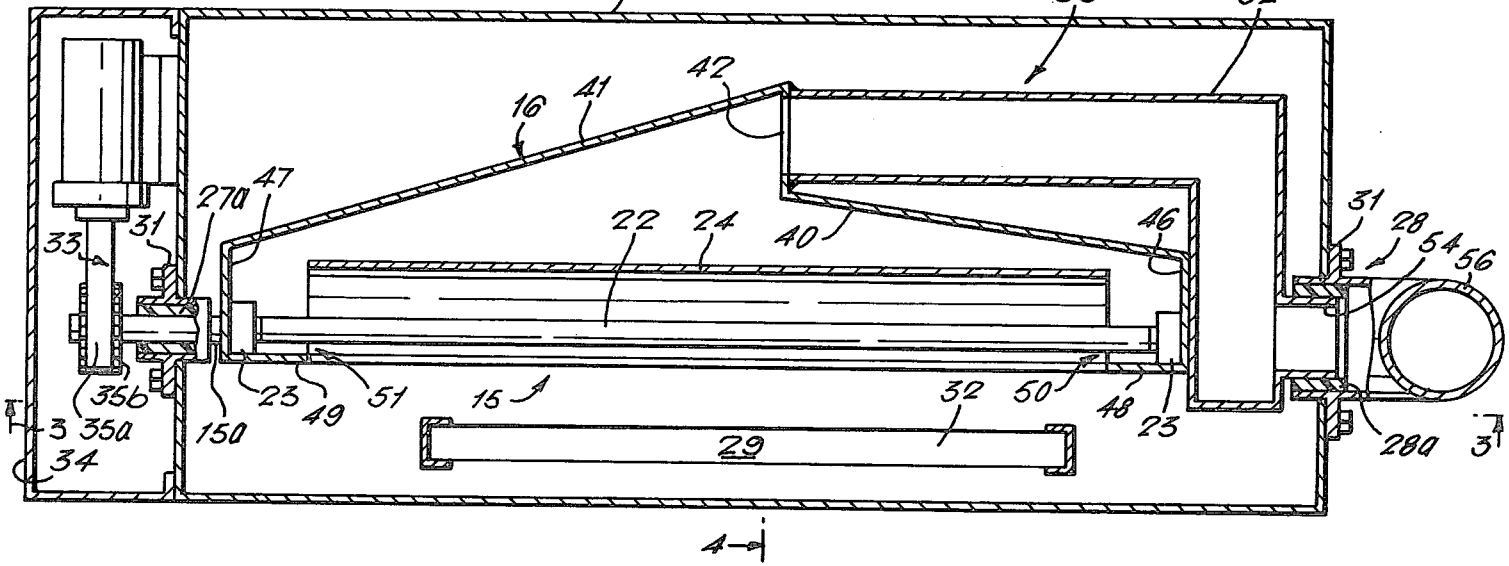
FIG. 2 is a horizontal cross-section through the drier of FIG. 1 on the line of the axis of the hood/irradiator assembly forming part of the drier, the assembly being shown in the operational position.
Figure 3:
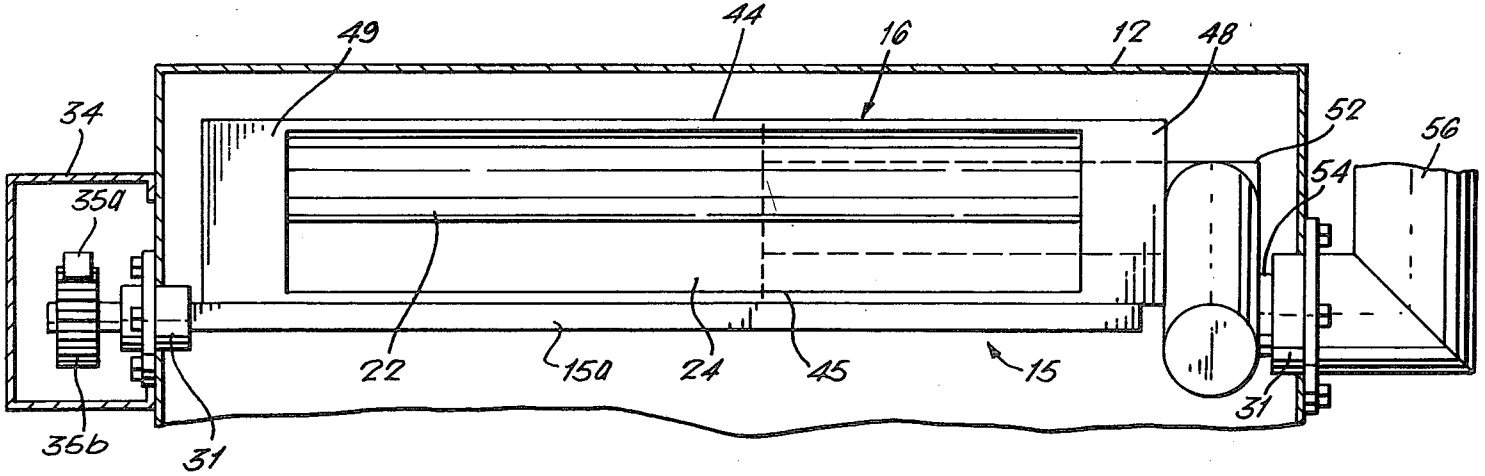

FIGS. 3 and 4 are respective cross-sections on the lines 3—3 and 4—4 in FIG. 2; and FIG. 5 is a view similar to FIG. 4 but shows the hood/irradiator assembly in the retracted or safety position.

The illustrated drier 10 includes an outer generally rectangular housing 12 bounding an enclosure 14 in which is mounted an assembly 15 comprising a hood 16 and an irradiator 18. Housing 12 is mounted atop a pair of spaced leg strands 20, 21.

Irradiator 18 is elongate and consists of a replaceable ultraviolet gas-discharge source tube 22 backed by a parabolic aluminium reflector 24 by which electromagnetic radiation is reflected to and focussed in a work space 29 to one side of the tube. This work space forms part of enclosure 14 and lies between opposite elongate slots 30, 32 in the upper and lower walls of housing 12. Slots 30, 32 serve to guide newly printed webs of paper through the enclosure for drying of the freshly impressed ink by the radiation emitted by the irradiator. The irradiator is closed off behind reflector 24 by hood 16 which also embraces ceramic end contacts 23 which lie outside the respective ends of the reflector and cooperate to retain the tube between them. Contacts 23 also provide electrical connections to the tube.

Assembly 15 is pivotable within enclosure 14 with a partially square-section (FIG. 4) mounting shaft **15*a* about the axis of the shaft, in bearings 27, 28 between an operational condition in which the irradiator is operably exposed to or faces work space 29 and a retracted or safety condition in which the irradiator is turned through 90° so to face away from space 29**. FIG. 4 shows the operational condition in full lines and the safety condition in ghost lines. In FIGS. 1 and 2 the assembly is shown in the safety condition.

Shaft **15*a* is parallel to tube 22 and may be hollow to receive electrical leads for the irradiator. It extends through bearing 27. The assembly is supported in bearing 28 by being coupled to a short duct section 54 which extends through the latter bearing coaxially with shaft and serves a purpose to be described below. Pivoting of the assembly is effected by way of a hydraulic ram 33 (FIG. 2) housed within drive casing 34 at one end of housing 12. Ram 33 reciprocates a ratchet 35*a* which is in engagement with a pinion 35*b* carried by shaft 15*a*. The rotational motion of assembly 15** is arranged to be initially rapid with an evenly braked stop on completion of the 90° turn.

The importance of rotating the hood/irradiator assembly is that it is possible to temporarily cease irradiation of the working space when the paper web stops moving or for performance of threading up or other operations in which the web may remain in the space, without turning off the irradiator source tube. Paper left exposed to the radiation will typically spontaneously ignite within a few seconds and it is generally desirable to wholly mask the radiation when the tube is not in use as even brief exposure can be hazardous to the eyes and skin of personnel operating the drier. A considerable saving of time and power is achieved as there is no longer need to allow the de-energization and restating of the tube. In practice, the tube is switched to half-power as rotation from the operational condition commences and returned to full power immediately the assembly starts to move back from the safety condition.

Bearings 27, 28 comprise sleeves 27*a*, 28*a* of a suitably heat resistance material such as Teflon mounted in matching flanged bosses 31 fixed to the housing within suitable apertures therein. A bearing of this type is found, in this application, to be less susceptible to seizure than many conventional ball and needle bearings, bearing in mind that a typical ultraviolet tube which might be incorporated into an ink drier would generate a local temperature as high as 600° C. Teflon is especially advantageous as it suffers no substantial distortion following heat expansion and subsequent recovery.

Hood 16 forms part of the arrangement for ventilating and thereby cooling the irradiator. More specifically, the hood includes planar converging bounding walls 40, 41 which respectively extend away from the irradiator from positions relatively close to the ends of the irradiator to the inner and outer sides, relative to the irradiator, of an opening 42 (FIG. 3) forming an air outlet port for the hood. Opening 42 lies in a plane at right angles to the irradiator and a little offset from its bisecting plane. Appropriately shaped side panels 44, 45 extend from opposite side edges of the boundary walls 40, 41 to the respective longitudinal edges of reflector 24. Respective end walls 46, 47 depend from the outer edges of walls 40, 41 about the end contacts 23 for the source tube and merge into longitudinally directed respective tab portions 48, 49 which embrace the end elements at positions such that air admission openings 50, 51 are provided between the inner ends of the tab portions and the reflector.

Port 42 communicates with the exterior of housing 12 by way of a duct 55 consisting of an elbow pipe 52 and the duct section 54, previously adverted to, which opens through the hollowed centre of bearing 28 for communication in turn with an external duct 56. Duct 56 is coupled in use of the drier to an appropriate air suction fan (not shown). The air cooling circuit is completed by slots 30, 32, which admit air to enclosure 14 and thereby to irradiator 18 and openings 50, 51. If desired, covered louvres may be provided in the side walls of housing 12 to increase the air intake cross-section.

It is found that the respective ceramic end contacts engaging and mounting an ultraviolet source tube, require cooling if early failure of the tube is to be prevented. Accordingly, the above described arrangement provides for air to be continuously drawn into the interior of hood 16 by way of openings 50, 51, the bulk of the air thereby passes across and/or about the contacts 23 and the ends of the tube. The heated air is taken off to the exterior of the unit by way of duct 55 and continuously replenished in enclosure 14 by ambient air entering by way of the slots 30.

It will be appreciated that the above described and illustrated unit allows for longer irradiator life by ensuring a proper and continuous cooling of the source tube and is considerably more efficient than previously known units by virtue of the irradiator being rotatable to direct radiation away from the web receiving space. It is also important that these two desirable ends are achieved in a manner which does not necessitate interruption of one or other of the cooling and rotation systems when the other is being applied.

I claim:

1. An irradiation unit comprising:

an outer housing defining an enclosure;

means for mounting an elongate irradiator, operable to emit electromagnetic radiation, for pivotal movement within the enclosure, which means includes one or more bearings received in an aperture or apertures in the housing; and means to permit ventilation of the irradiator to the exterior of the housing, which means includes a hood arranged to substantially close off one side of the irradiator, and an air outlet port for the hood, the hood being pivotable with the irradiator and having its outlet port communicating with the exterior of the housing by way of a duct passing within or about the or one of said bearings.

2. An irradiation unit according to claim 1 wherein said bearings comprise a pair of Teflon sleeves received in said apertures in the housing.

3. An irradiation unit according to claim 1 wherein the irradiator includes a tube operable to emit said electromagnetic radiation and wherein the irradiator is arranged to be pivotable about an axis parallel to and spaced from the tube when the latter is in position.

4. An irradiation unit according to claim 1, wherein said mounting means includes spaced end contacts for retaining a gas discharge tube comprising said irradiator, and wherein the interior of the hood is arranged relative to the tube such that in use the bulk of induced air flow through its outlet port has passed across and/or about the said contacts and the ends of the tube.

5. An irradiation unit according to claim 1 wherein the hood includes walls opposite the position for the irradiator which converge to the inner and outer sides, relative to the irradiator, of an opening constituting said air outlet port which opening lies in a plane substantially normal to the lengthwise dimension of the irradiator.

6. An irradiation unit according to claim 1 further including drive means to rotate the irradiator between a condition in which the irradiator is operably exposed to a work space within the enclosure and a condition in which it is not so exposed.

7. An irradiation unit according to claim 6, wherein the drive means includes a reciprocable ratchet and a pinion rotatable with the irradiator.

8. An irradiation unit according to claim 1 wherein the unit is used for drying treated webs and further comprises opposed slots in the housing to permit such webs to be passed through a work space within the enclosure.

9. An irradiation unit comprising:

an outer housing defining an enclosure;

an elongate irradiator including a tube for emitting electromagnetic radiation and a reflector extending along side the tube;

means for mounting the irradiator for pivotal movement about an axis parallel to the tube, which means includes one or more bearings received in an aperture or apertures in the housing; and means to permit ventilation of the irradiator to the exterior of the housing, which means includes a hood arranged to substantially close off the irradiator behind the reflector and an air outlet port for the hood, wherein the hood is pivotable with the irradiator within the enclosure, and wherein the outlet port for the hood communicates with the exterior of the housing by way of a duct passing within or about the or one of said bearings.

10. An irradiation unit according to claim 9, wherein said bearings comprise a pair of Telfon sleeves received in said apertures in the housing.

11. An irradiation unit according to claim 9 wherein the hood includes walls opposite the reflector which walls converge to the inner and outer sides, relative to the irradiator, of an opening constituting said air outlet port which opening lies in a plane substantially normal to the lengthwise dimension of the irradiator.

12. An irradiation unit according to claim 9, further including drive means to rotate the irradiator along said axis between a condition in which the irradiator is operably exposed to a work space within the enclosure and a condition in which it is not so exposed.

13. An irradiation unit according to claim 9, wherein the drive means includes a reciprocable ratchet and a pinion rotatable with the irradiator.

14. An irradiation unit according to claim 9, wherein the unit is used for drying treated webs and further comprises opposed slots in the housing to permit such webs to be passed through a work space within the enclosure.

* * * * *